US009359786B1

(12) United States Patent
Fenton

(10) Patent No.: US 9,359,786 B1
(45) Date of Patent: Jun. 7, 2016

(54) TENT WALL SYSTEM

(71) Applicant: Calvin Lloyd Fenton, Casper, WY (US)

(72) Inventor: Calvin Lloyd Fenton, Casper, WY (US)

( * ) Notice: Subject to any disclaimer, the term of this patent is extended or adjusted under 35 U.S.C. 154(b) by 0 days.

(21) Appl. No.: 14/603,355

(22) Filed: Jan. 22, 2015

(51) Int. Cl.

| | |
|---|---|
| ***E04H 15/02*** | (2006.01) |
| ***E04H 15/04*** | (2006.01) |
| ***E04F 15/04*** | (2006.01) |
| ***A45F 3/24*** | (2006.01) |

(52) U.S. Cl.
CPC *E04H 15/02* (2013.01); *A45F 3/24* (2013.01); *E04F 15/04* (2013.01)

(58) Field of Classification Search
CPC ..... E04H 15/02; E04H 15/04; A45F 3/22; A45F 3/24; A45F 4/08
USPC ..... 5/120, 121, 127–130
See application file for complete search history.

(56) References Cited

U.S. PATENT DOCUMENTS

| | | | | | |
|---|---|---|---|---|---|
| 35,032 | A | | 4/1862 | Morgan | |
| 209,275 | A | | 10/1878 | Leycester | |
| 638,174 | A | | 11/1899 | Diggins | |
| 640,334 | A | | 1/1900 | Tanner | |
| 851,927 | A | | 4/1907 | Fyfe | |
| 967,949 | A | * | 8/1910 | Meredith | A45F 3/22 5/121 |
| 1,209,479 | A | | 12/1916 | Nelson | |
| 1,343,800 | A | * | 6/1920 | Trimm | E04H 15/04 135/90 |
| 1,401,846 | A | * | 12/1921 | Wiles | A45F 3/22 5/121 |
| 1,464,875 | A | * | 8/1923 | Hull | A45F 4/02 224/154 |
| 1,621,464 | A | * | 3/1927 | Fortin | E04H 15/04 135/141 |
| 2,153,547 | A | * | 4/1939 | Charlop | E04H 15/324 135/121 |
| 4,001,902 | A | * | 1/1977 | Hall | A45F 3/22 5/121 |
| 4,071,917 | A | * | 2/1978 | Mojica | E04H 15/04 135/90 |
| 4,471,794 | A | * | 9/1984 | Kirkham, Jr. | E04H 15/30 135/95 |
| 4,757,563 | A | | 7/1988 | An | |
| 4,862,906 | A | * | 9/1989 | Jordon | A45F 3/22 135/117 |
| 5,113,537 | A | * | 5/1992 | Turk | A47D 9/02 135/90 |
| 5,240,021 | A | * | 8/1993 | Snodgrass | E04H 15/425 135/116 |
| 5,487,402 | A | * | 1/1996 | Clary | E04H 15/44 135/114 |
| 5,579,548 | A | * | 12/1996 | Death | A45F 3/24 5/120 |
| 5,715,552 | A | * | 2/1998 | DeAth | A45F 3/26 135/117 |
| 5,913,772 | A | | 6/1999 | Clark | |
| 5,915,400 | A | * | 6/1999 | Pohl | E04H 15/44 135/117 |
| 6,085,767 | A | * | 7/2000 | Maslow | E04H 15/04 135/121 |
| 6,347,638 | B1 | * | 2/2002 | Scott | E04H 15/04 135/115 |
| 7,699,068 | B2 | * | 4/2010 | Helsdon | A45F 3/22 135/90 |
| 8,161,991 | B2 | * | 4/2012 | Johnson | A45F 3/22 135/90 |
| 8,365,749 | B2 | * | 2/2013 | Overbaugh | E04H 15/001 135/125 |
| 8,936,034 | B2 | * | 1/2015 | Rhett, Jr. | E04H 15/34 135/90 |
| 2005/0188460 | A1 | * | 9/2005 | O'Brien | A45F 3/52 5/121 |
| 2008/0236642 | A1 | * | 10/2008 | Helsdon | A45F 3/22 135/90 |
| 2009/0265851 | A1 | * | 10/2009 | Clark | A45F 3/22 5/122 |
| 2011/0017251 | A1 | * | 1/2011 | Overbaugh | E04H 15/001 135/90 |
| 2012/0005827 | A1 | * | 1/2012 | Clark | A45F 3/22 5/121 |
| 2014/0158174 | A1 | * | 6/2014 | Rhett, Jr. | E04H 15/34 135/121 |
| 2014/0304911 | A1 | * | 10/2014 | Kramer | A45F 3/22 5/121 |

* cited by examiner

*Primary Examiner* — Robert Canfield
(74) *Attorney, Agent, or Firm* — Peter J. Timbers

(57) ABSTRACT

A system to elevate an internal object in a tent above the ground is provided. The system includes tent wall structure having tent wall material that is in contact an internal attachment that is in contact with the internal object and the tent wall material is also in contact with an anchor external to the tent. The system provides a means to elevate a hammock or other object inside a tent.

11 Claims, 10 Drawing Sheets

8

10

TENT WALL SYSTEM

FIELD OF THE INVENTION

This invention relates generally to a system of a tent wall that provides a means to support and elevate vertically an object inside a tent.

BACKGROUND OF THE INVENTION

Many campers find that sleeping on the ground in a sleeping bag, even with the aid of a pad or foam, is inherently uncomfortable. Further, when campers rise in the morning after sleeping on the ground, it is often with discomfort and stiffness, even if the ground is level.

Many campers look for various means to elevate objects for a variety of reasons, not just comfort. Tent quarters are often cramped and cluttered due to a camping objects, provisions and materials in the same space as sleeping bags and sleeping pads. Thus, campers have long sought a means to elevate some objects associated with camping inside a tent.

Hammocks have long been used for sleeping comfort. However, the condition of hammocks existing inside tents has not been suitably addressed to date. Thus, there is a long felt need for to provide additional comfort and space management inside tents.

SUMMARY OF THE INVENTION

Accordingly, it is an object of embodiments of the present invention to provide a tent wall system that enables a camper or other tent user to elevate an object inside a tent via a modified tent system.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims. To achieve the foregoing and other objects, and in accordance with the purposes of the present invention, as embodied and broadly described herein, the invention comprises a tent wall system providing a means for vertically supporting an object inside a tent, said tent wall system comprising a tent wall structure comprised of a tent wall material said tent wall material having an internal surface and an external surface and said tent wall structure attached to at least one tent wall of the tent, an anchor outside the tent, an external attachment having an anchor end in contact with said anchor and an external end in contact with said tent wall structure, and an internal attachment having an object end in contact with said object inside the tent and an internal end in contact with said tent wall structure. In one embodiment, the tent wall structure further comprises grommet attached to the tent wall material, said grommet in contact with the internal end of the internal attachment and said grommet in contact with the external end of the external attachment.

In another embodiment, the invention comprises a tent wall system wherein the tent wall material has an internal surface and an external surface and the internal surface is attached to an internal bracket and the external surface is attached to an external bracket attachment with the internal attachment connected to the internal bracket and the external attachment connected to the external bracket.

Benefits and advantages of the present invention include, but are not limited to, providing a means to elevate objects inside a tent via an anchor external to the tent, including, but not limited to a tent.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
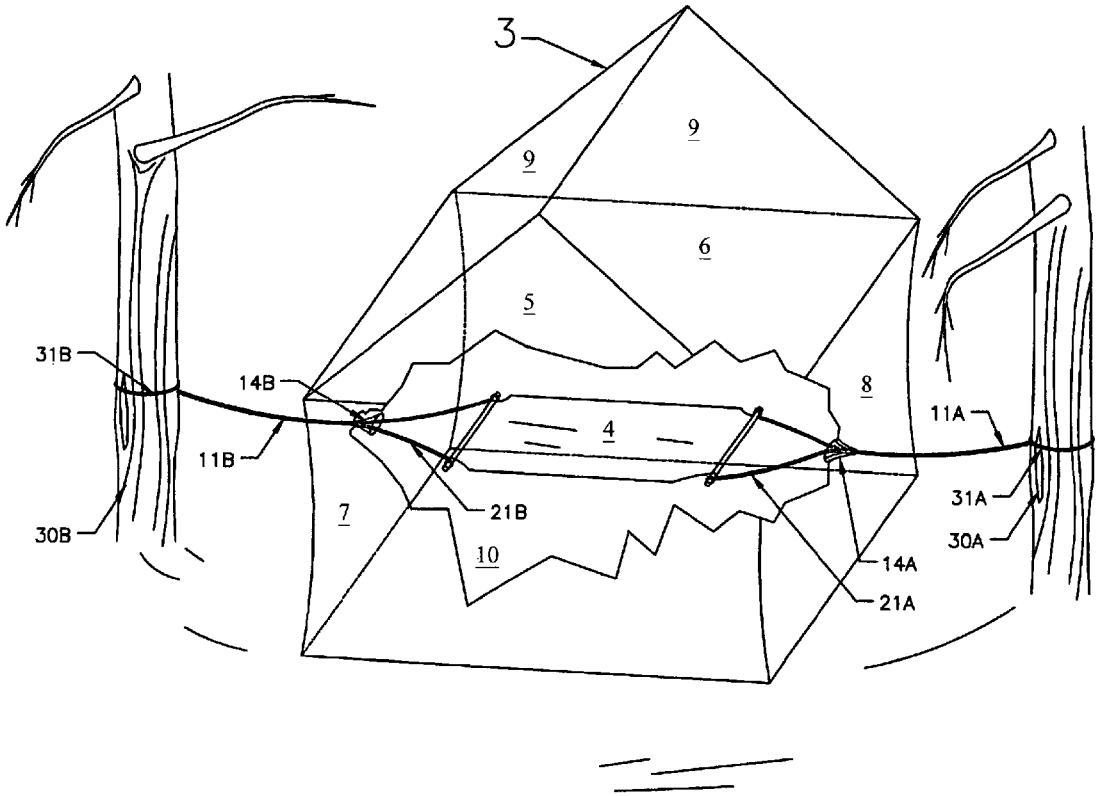
FIG. 1 illustrates a top right side perspective of one embodiment of the present invention.

Reference will now be made in detail to embodiments of the invention, examples of which are illustrated in the accompanying drawings. Throughout the following detailed description, the same reference characters refer to the same or similar elements in all figures.

FIG. 1 depicts a cutaway right side top perspective of one embodiment of the instant invention, wherein a tent 3 is shown in its upright and constructed condition, having a floor 10, ceiling 9, a front wall 5, a back wall 6, a first side wall 8 and a second side wall 7. Also depicted in FIG. 1 is an elevated object, in this embodiment, a hammock 4, which is elevated through contact with and connection to internal attachments 21A and 21B. In this embodiment, the end of internal attachment 21A is in contact with one end of external attachment 11A at the point of tent wall structure 14A in side wall 8. The other end of internal attachment 21A is in contact with the hammock 4. The other end of the external attachment is in connection contact with the anchor 30A. Similarly, internal attachment 21B is in contact with one end of external attachment 11B at the point of tent wall structure 14B in side wall 7. The other end of internal attachment 21B is in contact with the internal object, a hammock 4, and the other end of the external attachment is in connection contact with the anchor 30B.

The external attachments 11B and 11A are attached to anchors 30B and 30A, respectively, via external attachment attachments 31B and 31A, respectfully. In FIG. 1, the hammock 4 is vertically supported by anchors 30A and 30B, which comprise trees. In addition to the anchors comprising trees, the anchors may comprise poles or other sturdy structures able to accommodate weight, as loaded into the hammock 4.

The external attachment 11A is in contact with the tent wall structure 14A and the internal attachment 21A contacts with tent wall structure 14A. Similarly, the external attachment 11B is in contact with the tent wall structure 14A and the internal attachment 21B contacts with tent wall structure 14B.

In this embodiment, the hammock is shown having only internal attachment 21B in contact with the tent wall 7 at the point of tent structure 14B and the hammock has only one internal attachment 21A in contact with the tent wall 8 at the point of tent structure 14A. It is an object of this invention to provide a means to elevate an internal tent object with an external anchor wherein the only points of contact between the tent 3 and the hammock 4 comprise the internal attachments that suspend the internal object, often a hammock. The hammock 4 comprises a body portion, which is connected to attachments which provide support for the hammock. The body portion of the hammock 4 does not contact the tent wall in this invention as claimed in this invention.

Figure 2:
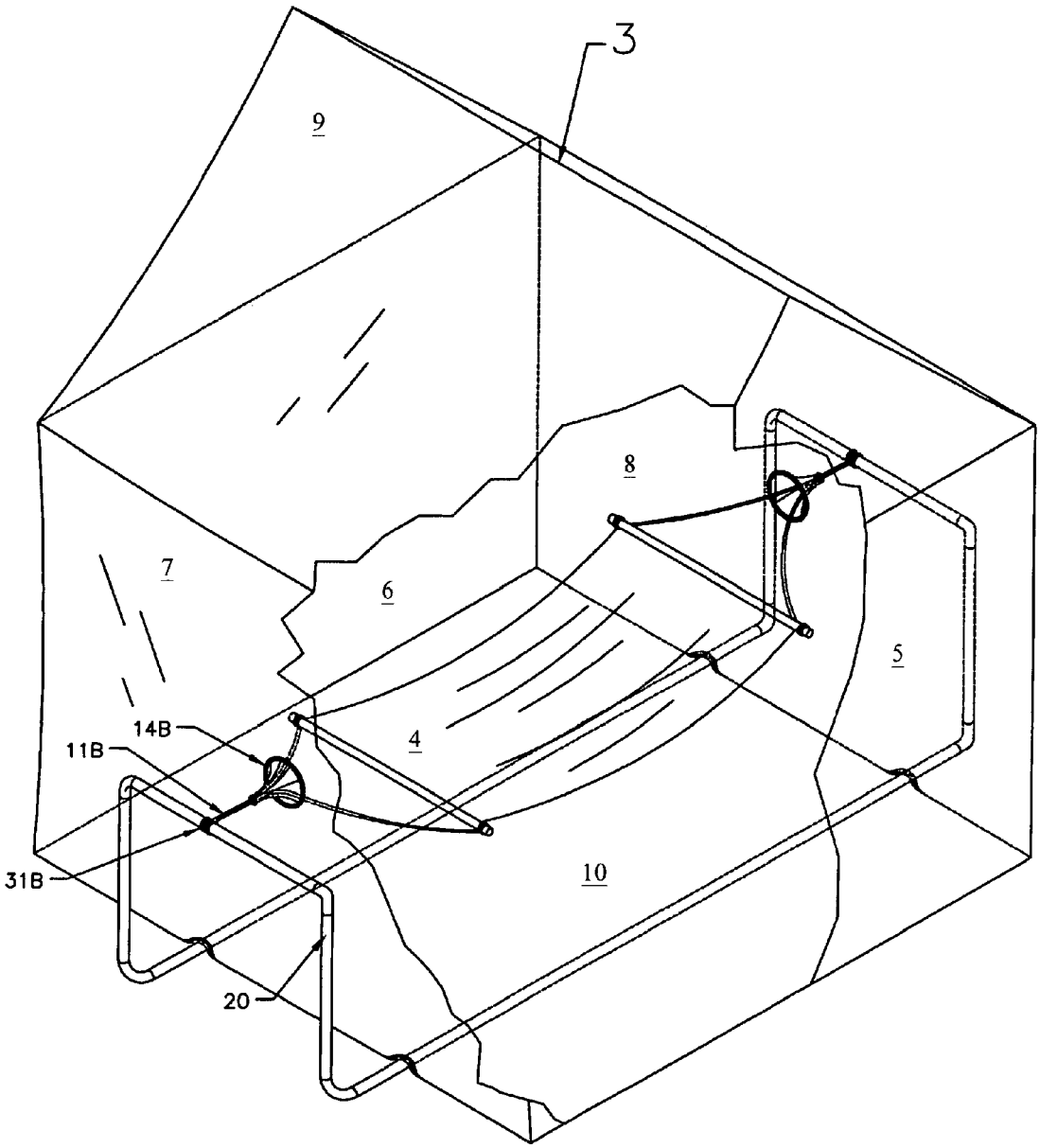
FIG. 2 illustrates top left side perspective view of one embodiment of the present invention.

FIG. 2 depicts a left side top perspective tear away view of another embodiment of the instant invention. In this embodiment, a tubular anchor system 20 provides the anchor support for the internal object, hammock 4. Similar to FIG. 1, the hammock has no other points of contact with the tent structure other than where the internal attachments provide contact to the tent wall structures 14A and 14B of the tent walls 7 and 8. Thus, in this invention, back wall 6, front wall 5 and the floor 10 and the remainder of the side walls 7 and 8 do not contact the hammock 4, or any other object elevated by the internal attachments.

Figure 3:
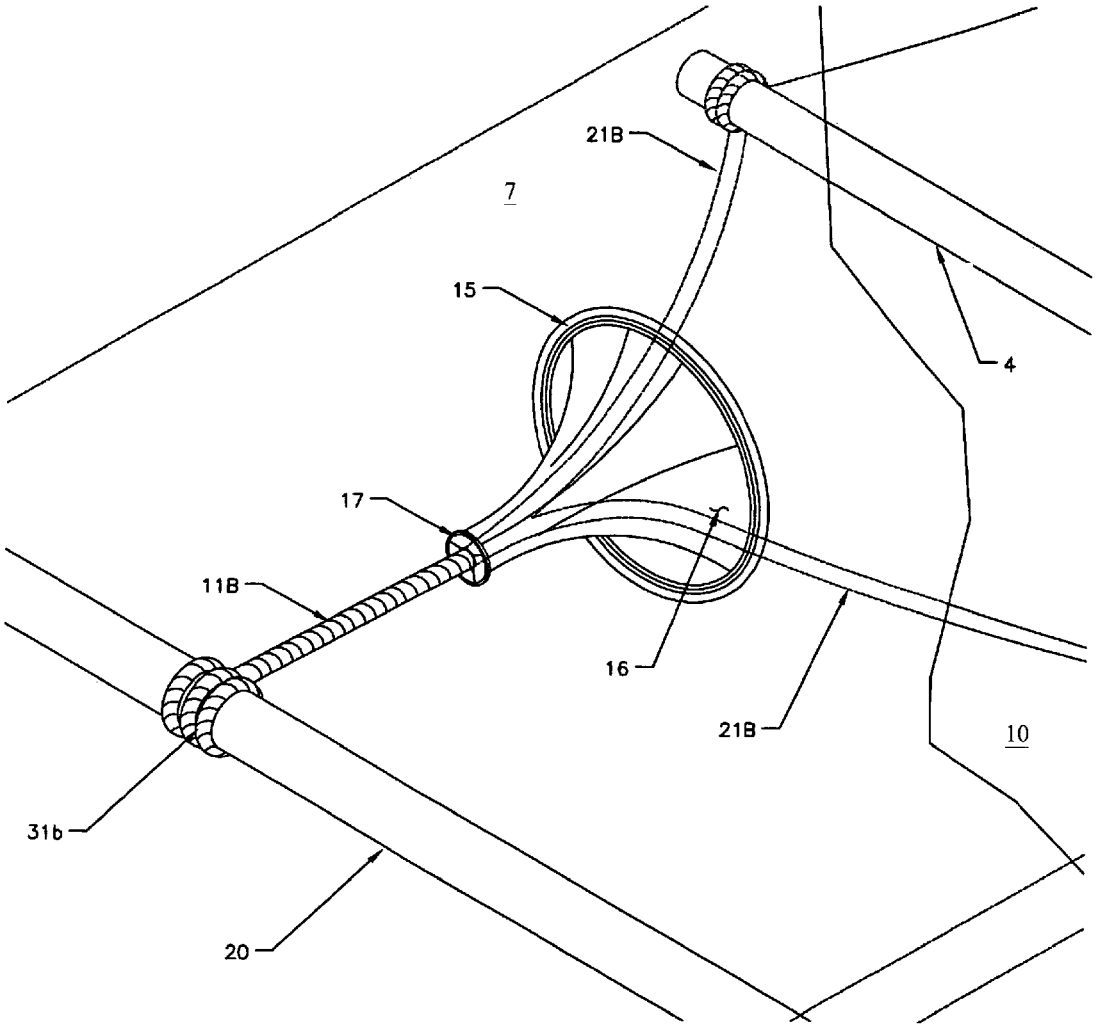
FIG. 3 illustrates an outside perspective side and top view of one embodiment of the present invention as shown in FIG. 2.

FIG. 3 is a blown up depiction of the tent wall system invention shown in FIG. 2 at the point of side wall 7. This view is from the outside of the tent, looking at the tent wall 7 with the 10 floor 10 beneath the hammock 4. The tent wall structure includes the o-ring 15, grommet 17 and the tent wall material 16. The tent wall structure's o-ring 15 separates the remainder of the tent wall 7 from the tent wall material 16. Further, tent wall material 16 is disposed between the o-ring 15 and a grommet 17 of the tent wall system. The grommet is in contact with the internal attachment 21B and the external attachment 11B. The cut away nature of this FIG. 4 blown up FIG. 2 also shows the hammock 4 inside the tent. The grommet 17 at least partially surrounds the internal attachment 21B and the external attachment 11B.

Figure 4:
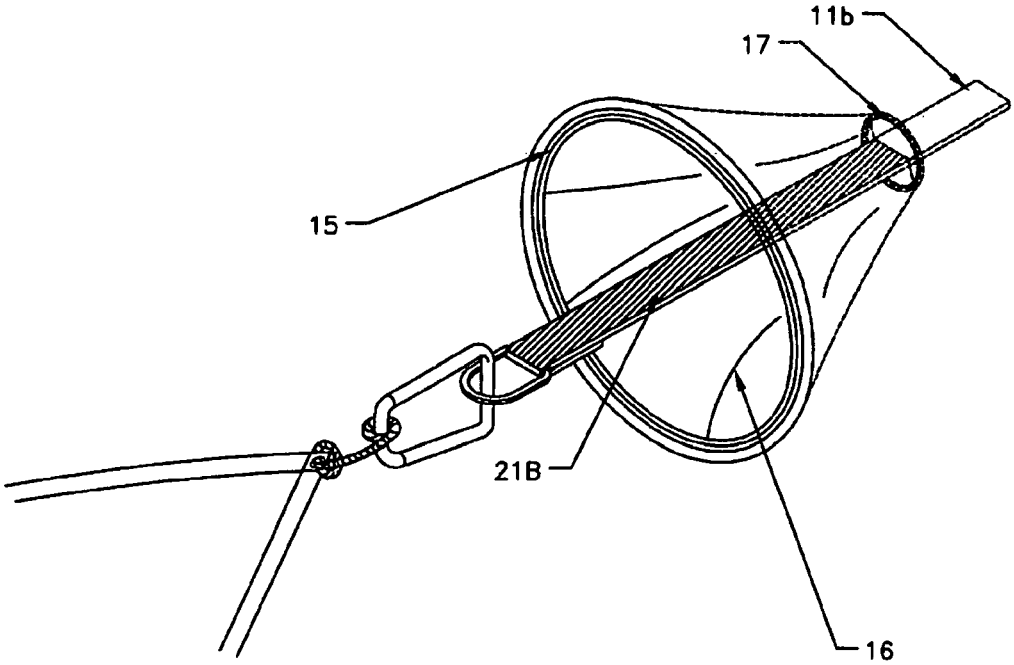
FIG. 4 illustrates an inside top view of one embodiment of the present invention.
Figure 4:
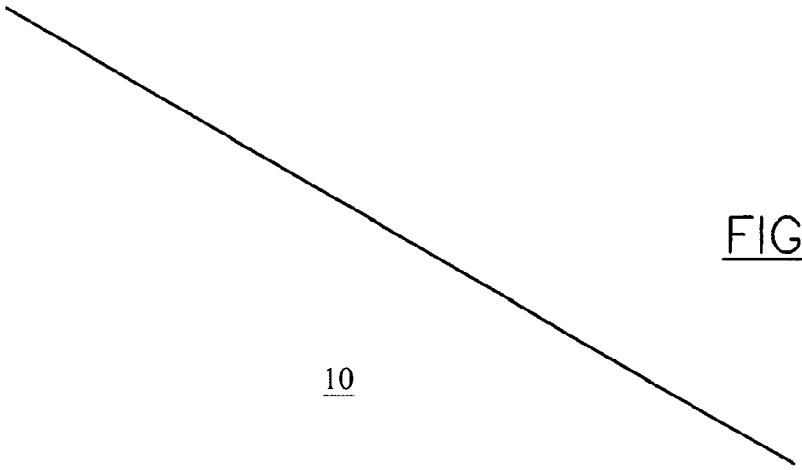

FIG. 4 depicts another embodiment of the tent wall system of the instant invention. This view is from the inside of the tent looking at the tent wall 7, the tent wall structure and the tent floor 10. The tent wall structure includes the o-ring 15, which is attached to the tent wall 8, the grommet 17 and the tent wall material 16 which is also attached to the o-ring 15. The grommet 17 is in contact with the external end of the external attachment 11B and the grommet is in contact with the intern end of the internal attachment 21B.

For purposes of this invention, the term "attachment" includes any material or device, cord, carabiner, clamp, or similar binding device that connects the internal object to the tent wall structure or the anchor to the tent wall structure or the anchor to the internal object. Also, for purposes of this invention, it is not necessary that the tent wall and the tent wall material of the tent wall structure be comprised of the same substance and it is contemplated that they may be comprised of the same substance or different substances.

Figure 5:
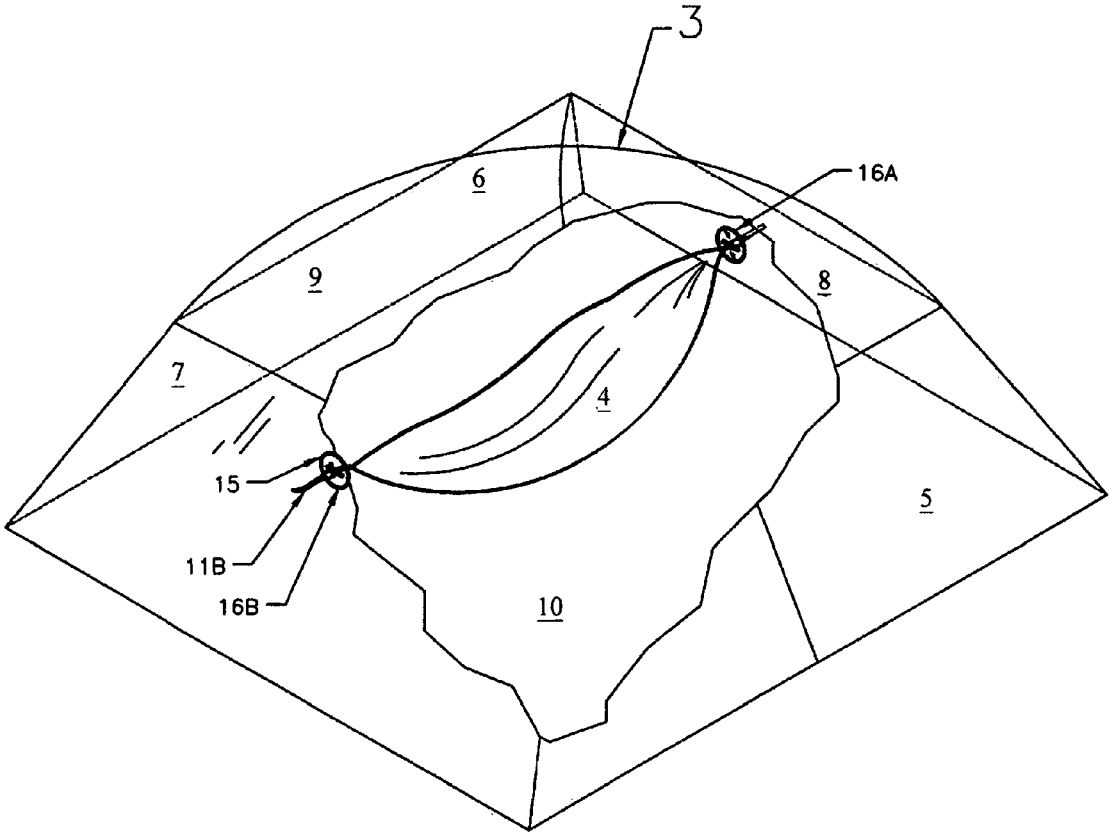
FIG. 5 illustrates one embodiment of the present invention from outside the tent.

FIG. 5 depicts yet another embodiment of the instant tent wall system invention. In this embodiment, the tent wall material includes an internal surface and an external surface, but does not have the grommet as previously depicted in FIGS. 1-4.

Figure 6:
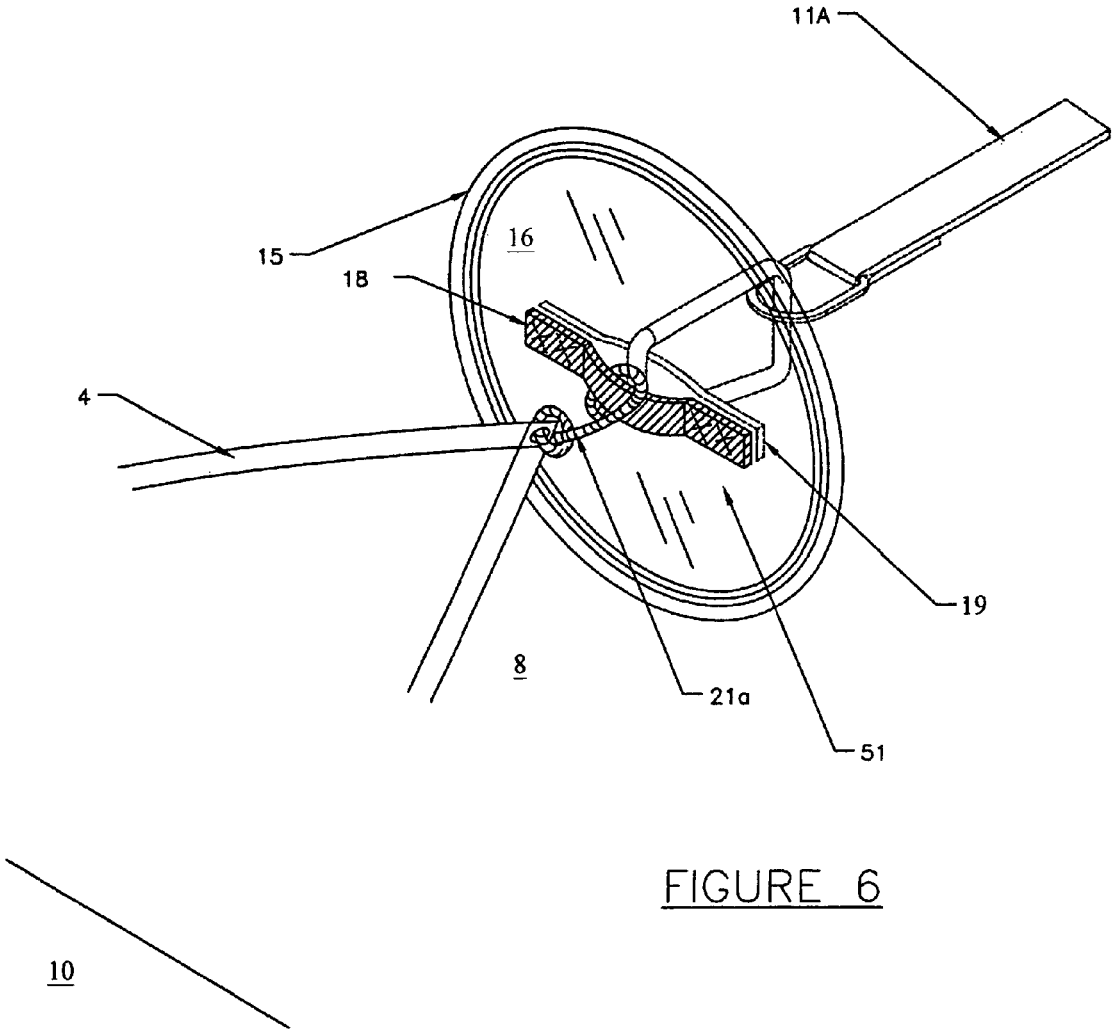
FIG. 6 illustrates an inside top view of one embodiment of the present invention.

FIG. 6 comprises an inside-the-tent depiction of the embodiment depicted in FIG. 5. In FIG. 6, the tent wall 8 is in contact with the tent wall structure, which comprises the tent wall material 16, the tent wall material's internal surface 51 and the o-ring 15. The internal surface 51 of the tent wall material 16 is in contact with an internal bracket 18. The internal bracket 18 is in contact with the internal attachment 21A, which is in contact with the not depicted internal object to be elevated inside the tent.

Figure 7:
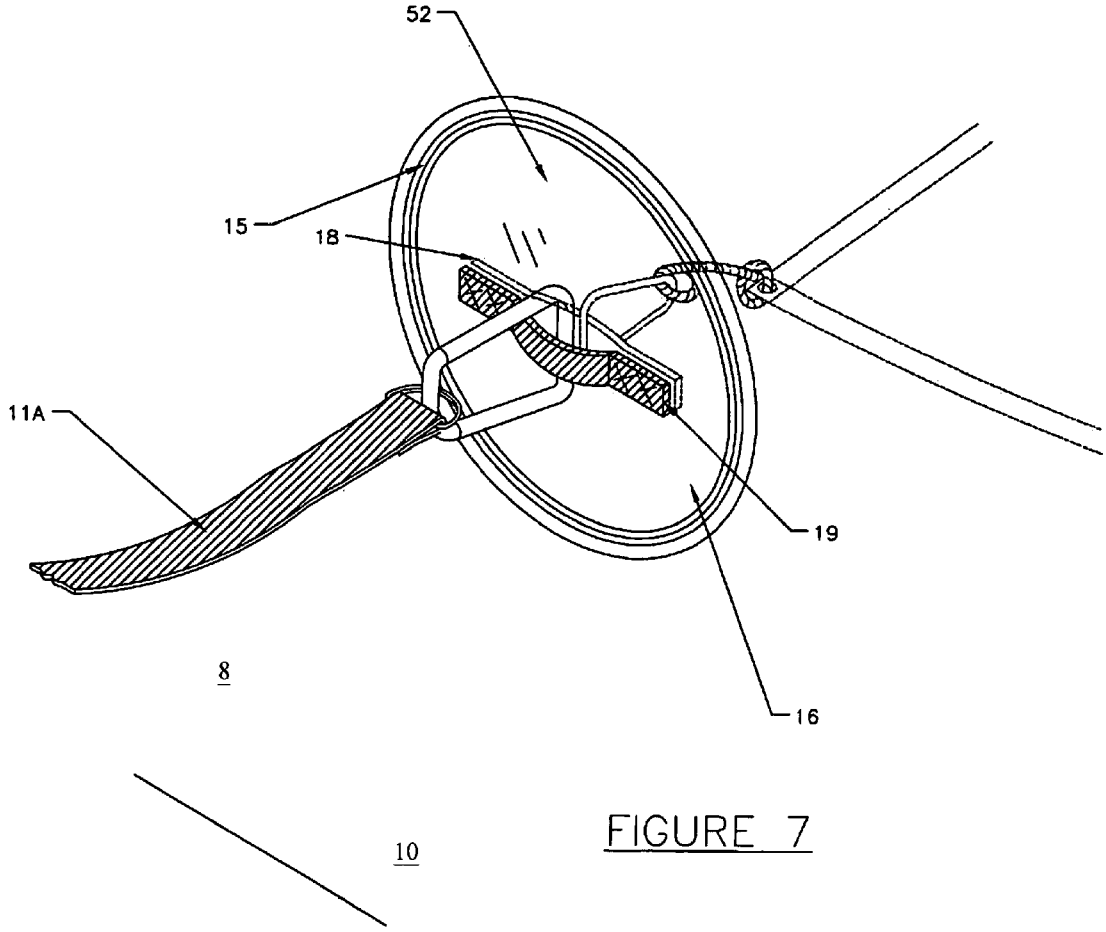
FIG. 7 illustrates an outside side view of one embodiment of the present invention.

FIG. 7 shows the outside view of FIG. 5. The tent wall 8 is in contact with the tent wall structure, which comprises the o-ring 15, the tent wall material 16 and the tent wall material's external surface 52. The external surface 52 of the tent wall material 16 is in contact o-ring 15 and is in contact with an external bracket 19, which is in contact with the external attachment, which is in contact with the not-depicted anchor, which provides support for the elevation of the internal object, also not depicted.

Figure 8:
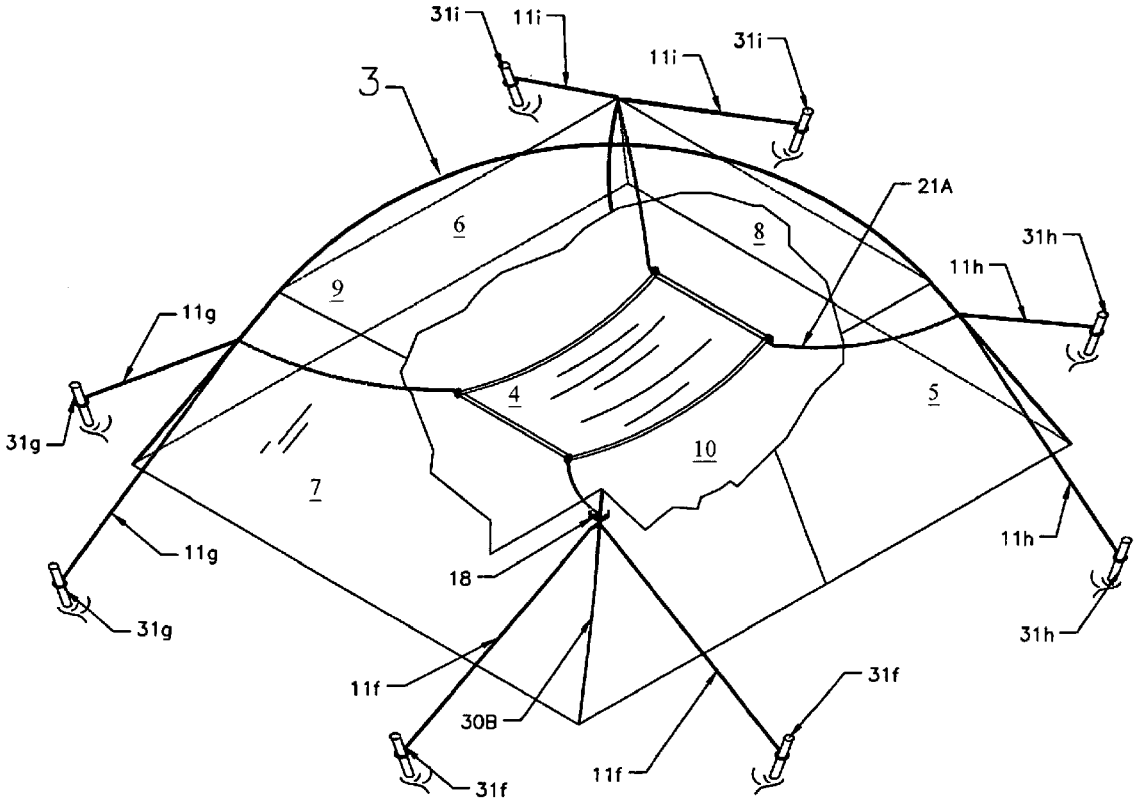
FIG. 8 illustrates one embodiment of the present invention.

FIG. 8 shows another embodiment of the instant tent wall system invention, wherein the tent 3 has a hammock 4 inside its structure. The hammock 4 is elevated by 8 anchors, two 31*f* anchors, two 31*g* anchors, two 31*h* anchors and two 31*i* anchors. Anchors 31*f* are connected to the external bracket 19*f* via external attachments 11*f*. The additional external brackets are anticipated, but not depicted for the remaining three corners of the tent 3, being contemplated to be in contact with similar brackets through the attachments 11*g*, 11*h* and 11*i* are in contact with respective anchors 31*g*, 31*h* and 31*i*, respectively.

Figure 9:
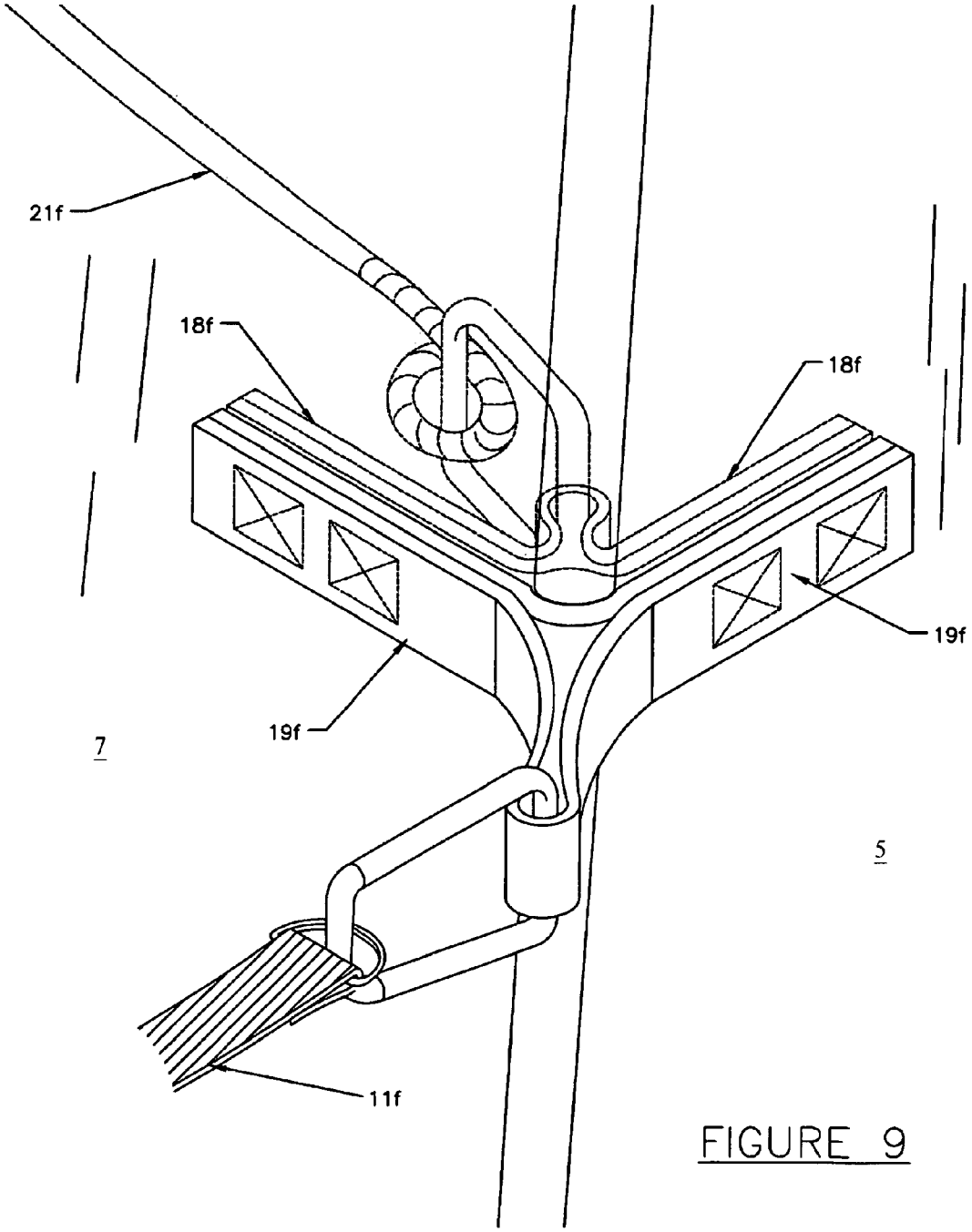
FIG. 9 illustrates an outside view of one embodiment of the invention.

FIG. 9 depicts a close-up view from the outside of the tent 3 at the corner of wall 7 and wall 5 of one embodiment of the instant invention. The external bracket 19 is in contact with the external attachment 11*f*. Again, the clamp is considered part of the attachment. FIG. 9 also shows the inside of the tent, wherein the internal bracket 18*f* is in contact with the internal attachment 21*f*. In FIGS. 8 and 9, the tent wall structure is comprised tent wall material, internal and external brackets, the tent wall structure's material disposed between the internal bracket 18 and external bracket 19. The internal surface of the tent wall material is in contact with the internal bracket and the external surface of the tent wall material is in contact with the external bracket.

Figure 10:
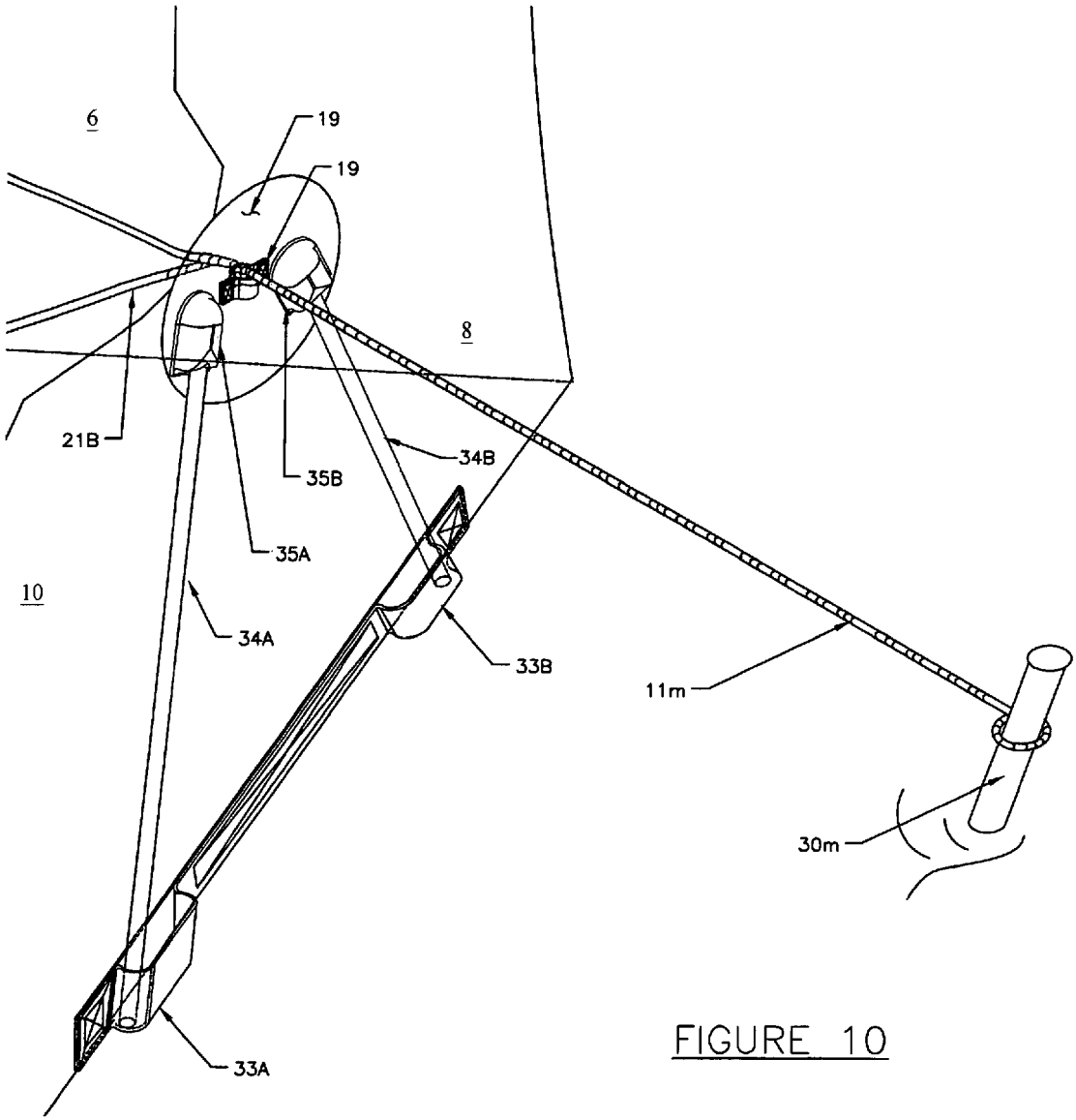
FIG. 10 illustrates another embodiment of the instant invention.

FIG. 10 depicts another embodiment of the instant invention, wherein the object inside the tent is secured by its connection to the external attachment 11*m* attached to anchor 30*m* and is vertically elevated by 2 inverted top pockets 35A and 35B and upright supports 34A and 34B. The inverted top pockets 35A and 35B are attached to tent wall 8 and the adapted to receive the top portions of upright supports 34A and 34B, respectfully. FIG. 10 also depicts two bottom pockets 33A and 33B that are attached to the tent wall 8 and adapted to receive the bottom portions of uprights 34A and 34B, respectfully. The connection of the tent wall structure to the anchor is consistent with FIGS. 5-9. In FIG. 10, the means of vertical elevation is supplied by upright supports 34A and 34B.

In the field, the tent walls and ceiling would be exposed to wind, however the wind has less effect with a tent wall structure that include tent wall material and a grommet, which provides movement of the tent wall without effecting the hammock. Further, the tent herein described has a floor isolated from the movement of the hammock inside the tent. The tent's floor being isolated from the hammock allows for enclosure and stability of camping supplies, such as boots, clothing, lanterns and food independent of the movement of the hammock. As has been shown throughout, tt is contemplated that the tent further comprises a tent floor and that the tent wall are in contact with the tent floor. Further it is contemplated the tent floor is in contact with a surface of earth underneath the tent. Alternatively, it is contemplated that the tent floor is in contact with a tarp underneath the tent and that the tarp is a barrier between the tent floor and the surface of the earth upon which the tent sits.

It is believed that the apparatus of the present invention and many of its attendant advantages will be understood from the foregoing description. It is also believed that it will be apparent that various changes may be made in the form, geometry, construction, and arrangement of the components without departing from the scope and spirit of the invention and without sacrificing its material advantages. The forms described are merely exemplary and explanatory embodiments thereof. It is the intention of the following claims to encompass and include such changes.

What is claimed is:

1. A tent wall system that elevates a hammock inside a tent, said tent having tent walls comprised of tent wall material, said tent wall material having an internal tent wall surface and an external tent wall surface, said tent wall system comprised of an external bracket, an internal bracket, an external attachment having two ends and internal attachment having two ends, said internal bracket attached to said internal tent wall surface, said internal attachment having one end attached to the internal bracket and the other end attached to the hammock, said external bracket attached to said external tent wall surface, said external attachment having one end attached to the external bracket and the other end attached to a vertical anchor, wherein the external bracket and the internal bracket are disposed in proximity to and opposite each other in their attachment to the tent wall material.

2. The tent wall system of claim 1, wherein the tent wall material further comprises an o-ring at least partially surrounding the internal bracket.

3. The tent wall system of claim 1, wherein the tent wall material further comprises an o-ring at least partially surrounding the external bracket.

4. The tent wall system of claim 1, wherein the tent wall material further comprises an o-ring at least partially surrounding the external bracket and the internal bracket.

5. The tent wall system of claim 1, wherein the tent further comprises a tent floor.

6. The tent of claim 1, wherein the tent further comprises a tent floor is in contact with a ground surface of the earth underneath the tent.

7. The tent of claim 1, further comprising a tent floor in contact with a tarp underneath the tent.

8. A tent wall system of claim 1, wherein the only point of contact between the hammock and the tent is by the internal attachment and in no other way does the hammock contact the tent.

9. The tent wall system of claim 1, wherein the vertical anchor comprises a tree.

10. The tent wall system of claim 1, wherein the internal attachment includes any device selected from the group consisting of cord, carabiner, clamp, or binding device.

11. The tent wall system of claim 1, wherein the external attachment includes any device selected from the group consisting of cord, carabiner, clamp, or binding device.

* * * * *